US008747638B2

(12) United States Patent
Jensen et al.

(10) Patent No.: US 8,747,638 B2
(45) Date of Patent: Jun. 10, 2014

(54) ELECTRODE ARRANGEMENT AND METHOD FOR ELECTROCHEMICAL COATING OF A WORKPIECE SURFACE

(75) Inventors: Jens Dahl Jensen, Berlin (DE); Ursus Krüger, Berlin (DE); Uwe Pyritz, Berlin (DE); Manuela Schneider, Berlin (DE); Gabriele Winkler, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 1982 days.

(21) Appl. No.: 11/995,122

(22) PCT Filed: Jul. 7, 2006

(86) PCT No.: PCT/EP2006/064014

§ 371 (c)(1),
(2), (4) Date: Mar. 31, 2008

(87) PCT Pub. No.: WO2007/006752

PCT Pub. Date: Jan. 18, 2007

(65) Prior Publication Data

US 2008/0202936 A1 Aug. 28, 2008

(30) Foreign Application Priority Data

Jul. 12, 2005 (DE) ..... 10 2005 033 857

(51) Int. Cl.
*C25D 15/00* (2006.01)

(52) U.S. Cl.
USPC ..... 205/109

(58) Field of Classification Search
CPC ..... C25D 5/026; C25D 5/08; C25D 15/00; C25D 15/02
USPC ..... 204/298.02; 205/109, 178, 179, 255, 205/110
See application file for complete search history.

(56) References Cited

U.S. PATENT DOCUMENTS

| | | | | |
|---|---|---|---|---|
| 4,027,366 | A | 6/1977 | Millar et al. | |
| 4,826,508 | A * | 5/1989 | Schwartz et al. | 51/293 |
| 5,865,976 | A * | 2/1999 | Takeuchi et al. | 205/109 |
| 6,221,230 | B1 | 4/2001 | Takeuchi et al. | |
| 2004/0084318 | A1 * | 5/2004 | Cohen | 205/98 |

FOREIGN PATENT DOCUMENTS

| | | | |
|---|---|---|---|
| DE | 197 02 366 | C2 | 8/1997 |
| DE | 198 21 781 | A1 | 11/1998 |
| EP | 0 559 608 | | 2/1993 |
| EP | 0 709 493 | A2 | 5/1996 |
| EP | 0 748 883 | A1 | 12/1996 |
| EP | 1 094 134 | A1 | 4/2001 |
| EP | 1 416 068 | A2 | 5/2004 |
| LU | 67358 | | 4/1973 |

* cited by examiner

*Primary Examiner* — Nicholas A Smith
*Assistant Examiner* — Ciel Thomas
(74) *Attorney, Agent, or Firm* — Staas & Halsey LLP

(57) ABSTRACT

A method for the electrochemical coating of a workpiece surface (2), micro- or nanoscale particles being introduced into the coating is provided. During coating, at least one jet composed of a jet medium comprising the micro- or nanoscale particles to be introduced is directed onto the workpiece surface (2).

9 Claims, 2 Drawing Sheets

ELECTRODE ARRANGEMENT AND METHOD FOR ELECTROCHEMICAL COATING OF A WORKPIECE SURFACE

The present invention relates to a method for electrochemical coating of a workpiece surface, with microscale or nanoscale particles being introduced into the coating. The invention also relates to an opposing electrode arrangement for electrochemical treatment of a workpiece, in which the workpiece forms a working electrode.

Methods and apparatuses such as these which can be used for example for new coating or recoating of turbine blades with a protective layer against corrosion and/or oxidation, are known, for example, from EP 0 748 883 A1 and EP 1 094 134 A1.

EP 0 748 883 A1 describes a method for production of galvanic layers, in which the component to be coated is introduced into an electroplating bath. Nanoparticles are introduced into the electroplating bath and are introduced into the coating during the electroplating process. In order to achieve a uniform distribution of the nanoparticles in the electroplating bath, the bath is stirred continuously. This is the only way in which it is possible to ensure that the nanoparticles are distributed homogeneously in the coating.

EP 1 094 134 A1 discloses an electrochemical apparatus for removal of a coating from a workpiece. The apparatus has a container into which an electrolyte can be introduced. The workpiece to be processed is introduced into the electrolytic bath as a working electrode in the form of an anode. A number of cathodes are also arranged in the electrolyte, and form opposing electrodes to the anode. During the electrochemical processing, a voltage is formed between the workpiece as the working electrode and the opposing electrodes. The opposing electrodes may be shaped specifically with regard to the workpiece to be processed.

Against the background of this prior art, one object of the invention is to provide an alternative method for electrochemical coating of a workpiece with a coating containing microscale or nanoscale particles. A further object of the present invention is to provide an opposing electrode arrangement, which can be used with particularly good flexibility and by means of which the method according to the invention can be carried out.

The first object is achieved by a method as claimed in claim 1, and the second object is achieved by an opposing electrode arrangement as claimed in claim 7. The dependent claims contain advantageous refinements of the invention.

In the method according to the invention, a workpiece surface is coated electrochemically, with microscale or nanoscale particles being introduced into the coating. During the coating process, a plurality of jets composed of a jet medium are directed at the workpiece surface, with the jet medium comprising the microscale or nanoscale particles to be introduced. The jets allow the microscale or nanoscale particles to be introduced specifically into the vicinity of the workpieces surface to be coated without having previously to place it in an electrochemical bath with the microscale or nanoscale particles. During the coating process, the particles are moved into the vicinity of the surface to be coated solely by the jets, in which case the large number of jets even allow homogeneous coating of relatively large surface contents or of complicated geometries. In this case, there is no need for continuous stirring of the electroplating bath.

In one embodiment of the method, the jet medium is formed solely by the microscale or nanoscale particles. In one alternative embodiment, the microscale or nanoscale particles are dispersed in an electrolytic treatment solution. In this embodiment, the jet medium is formed by the treatment solution with the particles dispersed in it.

The quantity of microscale or nanoscale particles introduced into the coating can be varied in the method according to the invention by means of the jet pressure, that is to say the pressure with which the jet medium is supplied to the surface. In this case, in particular, it is possible to use a continuous or a pulsating pressure profile. The number of particles introduced can thus be increased or decreased by means of suitable pressure control.

If the jet pressure is varied during the electrochemical coating process, it is possible to produce a gradient of the particle density in the electrochemically produced coating or a coating with a plurality of layers whose particle densities differ from one another. In this case, the pressure amplitude is varied continuously in order to produce the gradient, while the pressure amplitude is varied suddenly in order to produce a multilayer coating.

A multilayer coating can also be produced by varying the composition of the jet medium during the coating process. For example, it is possible to change from microscale or nanoscale particles of one type to microscale or nanoscale particles of a different type during the coating process. This change can be carried out either smoothly or suddenly. In the case of a smooth change in the particle type, there is a smooth transition in the completed coating from one particle type to the other particle type. If, in contrast, the jet composition is changed suddenly, then this makes it possible to produce a coating with a plurality of layers, with the individual layers differing from one another in the type of microparticles or nanoparticles. The variation of the jet composition can also be combined with variation of the let pressure so that not only the type of particles introduced but also their density in the completed coating are varied.

Overall, the method according to the invention improves the flexibility for production of coatings with microscale or nanoscale particles incorporated in them. The coating characteristics can be varied deliberately during the production of the coating. This makes it possible to produce completely novel layer systems. The process duration can also be shortened since there is no need first of all to make use of a new electrochemical bath, for example if the aim is to produce a multilayer system, in which the individual layers differ from one another by the type of microscale or nanoscale particles.

An opposing electrode arrangement according to the invention for electrochemical treatment of a workpiece, which in particular makes it possible to carry out the method according to the invention, comprises a number of process electrodes, with the workpiece forming a working electrode. The opposing electrode arrangement also comprises a process medium supply device in order to supply a process medium, which may be composed, in particular, of microscale or nanoscale particles, to the process electrodes.

The process electrodes are in the form of tubular elements with channels extending in their interiors. They each have one end facing the process medium supply device and one end facing away from the process medium supply device, with an opening arranged therein. The channels are each connected to the process medium supply device in the area of the ends of the tubular elements facing the process medium supply device. The channels open into the openings of the process electrodes at the end of the tubular elements facing away from the process medium supply device.

The use of tubular elements as the process electrodes, and the channels which are arranged in them, make it possible to specifically introduce a process medium, such as microscale or nanoscale particles or a mixture of a chemical treatment solution and microscale or nanoscale particles dispersed in it, as a jet medium in the form of a jet into the area between the process electrodes and the working electrode as the workpiece. This allows effective use of the microscale or nanoscale particles during the coating process.

Since different process media can be supplied via the process medium supply device without any need to interrupt the coating process, for example in order to change the electrochemical treatment solution, it is possible to form layers with a plurality of layers that differ in the particles used, without interruption of the electrochemical deposition process.

In one advantageous refinement of the opposing electrode arrangement, the channels taper in the area in front of the openings. The opening cross section tapering in this way makes it possible to form a nozzle-like opening which ensures that the microscale or nanoscale particles in the electrochemical treatment solution are thoroughly homogeneously mixed in the area in the vicinity of the opening. The quality of the jet, for example the shape of the jet and/or the energy of the jet and/or the amount of jet medium emerging, can be influenced deliberately by suitable design configuration of the nozzle, in particular by suitable choice of the shape of the channels in the area of the openings and/or the shape of the openings themselves, with respect to the jet quality to be achieved.

In order to allow the density of the microscale or nanoscale particles introduced into the coating to be increased or decreased, the opposing electrode arrangement may have an adjustment device for adjusting the pressure of the process medium in the process medium supply device.

In a first design refinement of the opposing electrode arrangement, the tubular elements of the process electrodes are passed through a common wax-filled mount. They have securing elements, for example ribs which extend in the circumferential direction of the tubular elements of the process electrodes and secure them against axial movement with respect to the wax in the solidified state.

The described refinement allows an advantageous method for matching the process electrode arrangement to the geometry of the workpiece to be processed. The wax is liquefied, and the process electrode arrangement is pressed against the workpiece with the wax liquefied. In the process, the process electrodes are moved in the wax so that the positions of the free ends of the process electrodes are matched to the geometry of the workpiece surface. The wax is solidified again in this state, so that the process electrodes are fixed in that position. This results in an opposing electrode arrangement which is optimally matched to the geometry of the surface of the workpiece to be processed. This matching is particularly important for non-planar workpieces and in the areas of concave and convex corners. In particular, concave and convex corners can be processed particularly well if the tubular elements of the process electrodes are in the form of needles. In addition, the opposing electrode arrangement can also be used, if the tubular elements are in the form of needles, particularly advantageously for chemical treatment of holes in the workpiece.

In a second design refinement of the opposing electrode arrangement, the tubular elements of the process electrodes are passed through holes in at least one common mounting plate. In this case, a small clearance is provided between the edges of the holes and the respective tubular elements, and is of such a size that it allows undisturbed axial movement of the tubular elements. Furthermore, a clamping apparatus is provided, by means of which the tubular elements can be pressed against the edges of the holes with a force such that they are secured against axial movement with respect to the mounting plate because of the friction that occurs in this case.

As in the first design embodiment, the opposing electrode arrangement in the second design embodiment can also be matched to the geometry of the surface of the workpiece to be processed by pressing it against the workpiece. In this case, the clamping apparatus is in the unclamped state, so that the tubular elements of the process electrodes can be moved axially within the holes. Once the position of the free electrode ends has been matched to the geometry of the workpiece surface, the clamping apparatus is tightened so that the tubular elements are pressed against the edges of the holes, thus securing them against further axial movement. In this design refinement as well, process electrodes in the form of needles offer the advantages described with respect to the first refinement.

Overall, the opposing electrode arrangement according to the invention can be used particularly flexibly for electrochemical treatment of workpieces. Particularly in the two described design refinements, the opposing electrode arrangement according to the invention can be used particularly variably, for any workpiece shape. There is therefore no need for specifically manufactured shaped electrodes for specific workpiece shapes.

Further features, characteristics and advantages of the method according to the invention and of the opposing electrode arrangement according to the invention will become evident from the following description of exemplary embodiments and with reference to the attached figures, in which.

Figure 1:
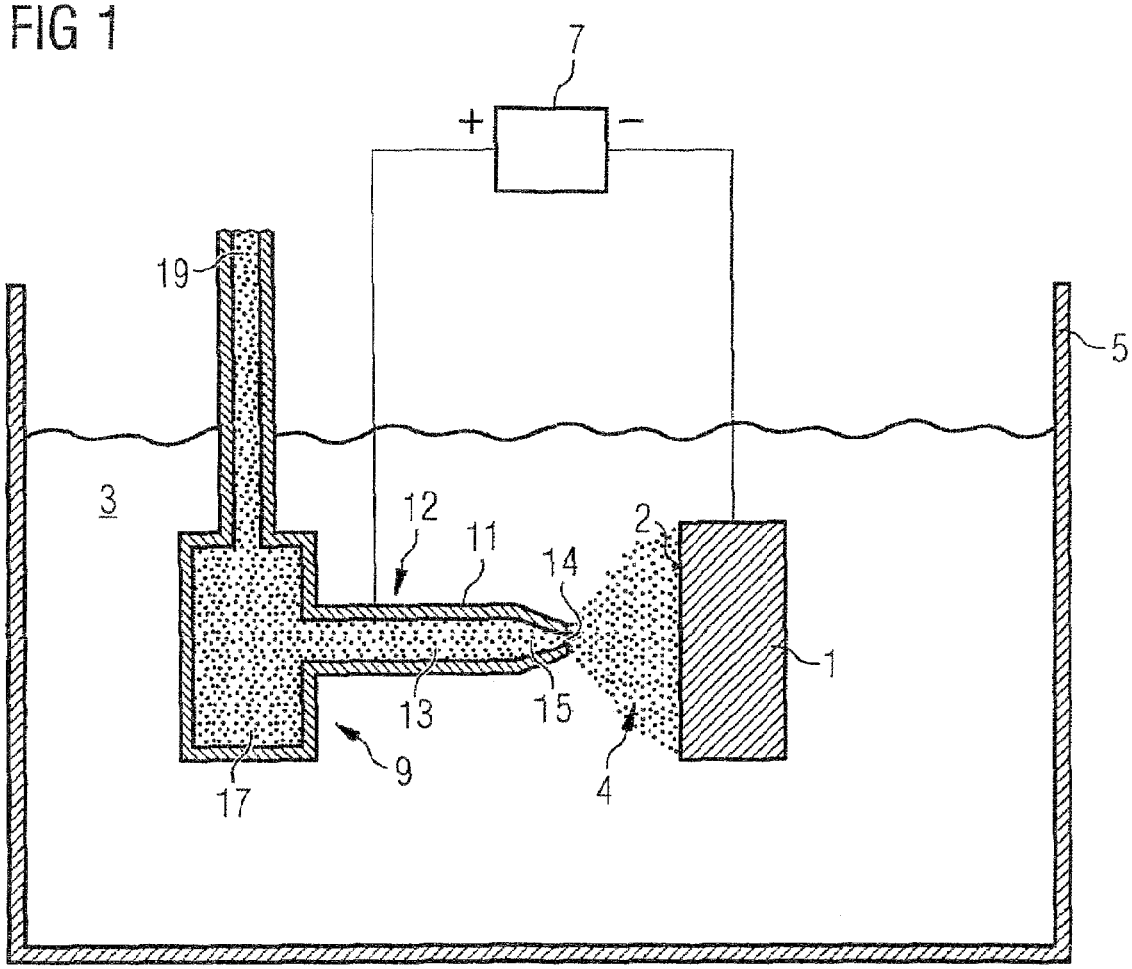
FIG. 1 shows an arrangement for carrying out one exemplary embodiment of the method according to the invention

The method according to the invention will be described in the following text with reference to the arrangement illustrated in FIG. 1. FIG. 1 shows a workpiece 1 which in particular, may be in the form of a turbine blade. A turbine blade is typically made from a nickel-based alloy that is resistant to high temperatures, or from a cobalt-based alloy. So-called MCrAlY coatings frequently have to be applied to turbine blades, for corrosion and/or oxidation protection. In the MCrAlY coating, M represents iron (Fe), cobalt (Co) or nickel (Ni), and Y represents yttrium (Y) and/or silicon (Si) and/or at least one element from the rare earths or hafnium. MCrAlY compositions are known, for example, from EP 0 486 489 B1, EP 0 786 017 B1, EP 0 412 397 B1 or EP 1 306 454 A1. Reference is therefore made to these documents with regard to possible compositions of the coating.

During the formation of an MCrAlY coating, cobalt or nickel is deposited electrochemically while in contrast the other components of the coating, for example Cr, Al, Y or rhenium (Re) are introduced as microscale or nanoscale particles into the electrochemically deposited nickel or cobalt layer.

The arrangement illustrated in FIG. 1 for coating the workpiece 1 has, in addition to the workpiece 1 itself, an electrode arrangement 9 and a container 5 which is filled with an electrolyte 3 and in which both the workpiece 1 and the electrode arrangement 9 are arranged. Furthermore, the arrangement has a voltage source 7, whose negative pole is electrically conductively connected to the workpiece 1, so that it forms a cathode. The cathode, that is to say the workpiece 1, forms the working electrode of the arrangement. The positive pole of the voltage source 7 is in contrast connected to the electrode arrangement 9, so that this becomes the anode, and forms the opposing electrode to the working electrode. The voltage which is applied between the workpiece 1 and the opposing electrode arrangement 9 results in an electrical field being formed between the opposing electrode arrangement and the workpiece 1, and this field transports positively charged ions towards the negatively charged workpiece surface.

Ions of the basic material of the workpiece are dissolved in the electrolyte 3, which represents an electrolytic treatment solution. In the case of a turbine blade composed of an alloy based on nickel or cobalt, nickel ions or cobalt ion are therefore dissolved in the electrolyte 3. The positively charged metal ions migrate towards the workpiece surface 2, where they are deposited to form a coating.

In the method according to the invention, microscale or nanoscale particles are introduced into the coating. This is done by creating a dispersion 4 of the microscale or nanoscale particles to be introduced in the electrolyte 3, between the opposing electrode arrangement 9 and the surface 2 of the workpiece 1. Particles which are adjacent to the surface 2 of the workpiece 1 are in this case introduced into the coating during the electrochemical deposition of the metal ions. The particles that are supplied may in this case be in the form of individual particle types, for example Cr particles, Y particles, A1 particles, Re particles, etc., or a mixture of a plurality of particle types.

The microscale or nanoscale particles are supplied into the area between the opposing electrode arrangement 9 and the workpiece 1 through the opposing electrode arrangement 9. For this purpose, the opposing electrode arrangement 9 is equipped with a number of tubular elements 11, which form the process electrodes 12 of the opposing electrode arrangement 9. For the sake of simplicity, FIG. 1 shows only one tubular element 11.

The tubular elements 11 have a channel 13 which runs in the axial direction and opens in an opening 14 in the end of the tubular element 11 facing the workpiece 1. Immediately in front of the opening 14, the cross section of the channel 13 tapers. The other end of the tubular element 11 is connected to a distribution tank 17, to which microscale and/or nanoscale particles can be supplied via an inlet 19 which, in the present exemplary embodiment, is in the form of an inlet tube.

While the workpiece 1 is being coated, the microscale or nanoscale particles are introduced under pressure via the inlet 19 into the distribution tank 17. As a result of the pressure, the particles flow through the channel 13 to the opening 14, and emerge through this into the electrolyte 3 in the area between the opposing electrode arrangement 9 and the workpiece 1. The nozzle-like openings 14 of the tubular elements 11 which are connected to the distribution tank 17 allow the particles to be thoroughly and homogeneously mixed in the electrolyte, or allow the workpiece surface 2 to be deliberately bombarded with the particles during the deposition of the dissolved metal ions. The microscale or nanoscale particle may in this case be transported at a specific pressure through the nozzle-like openings 14 to the workpiece surface 2.

In the present exemplary embodiment, the particles are supplied to the distribution tank dispersed in the electrolyte. An electrolyte jet therefore emerges from the nozzle-like opening 14 with dispersed microscale or nanoscale particles, as the jet medium. However, alternatively, it is also possible to introduce only the microscale or nanoscale particles into the distribution tank 17, so that only the particles emerge from the nozzle-like opening 14, as the jet medium.

The number of microscale or nanoscale particles located in the area between the opposing electrode arrangement 9 and the workpiece 1 can be deliberately increased or decreased by suitable control of the pressure in the distribution tank 17. This allows the incorporation density of the particles in the coating to be specifically increased and decreased. The pressure ratios in the distribution tank 17 can be varied, for example, via the pressure in the inlet 19. Both continuous pressures and pulsating pressures are possible. The pressure can in this case be controlled both by the pressure amplitude and by the frequency in the case of pulsating pressures.

The method according to the invention can also be used to produce graded coatings, that is to say those coatings in which the density of microscale or nanoscale particles introduced varies with the distance from the workpiece surface. This is done by continuously varying the pressure in the distribution tank 17 during the course of the coating process, so that the number, that is to say the density, of particles dispersed in the electrolyte between the opposing electrode arrangement 9 and the workpiece 1 is varied.

However, the method according to the invention can also be used to produce multilayer systems, in which the individual layers in the coating system may differ from one another both in the density of the microscale or nanoscale particles introduced and in the type of microscale or nanoscale particles. Layers such as these may, in particular, be produced without having to interrupt the electrochemical treatment process, in order to replace the electroplating bath. In order to produce coatings with a plurality of coatings with particles of types which differ from one another, the distribution tank 17 just has to be filled with microscale particles or nanoscale particles of a different type successively during the process. Whenever one layer has been completed, the distribution tank 17 is filled with the next particle type.

Coatings with layers which differ from one another in the density of the particles introduced can be produced by continuously varying the pressure ratios in the distribution tank 17. At this point, it should be noted that the method according to the invention can also be used to produce multilayer systems which differ from one another in the type of particle, and have a graded or sudden change in the density of the particles introduced. This is possible since the type of particles introduced into the distribution tank 17 and the pressure in the distribution tank 17 can be controlled independently of one another.

Figure 2:
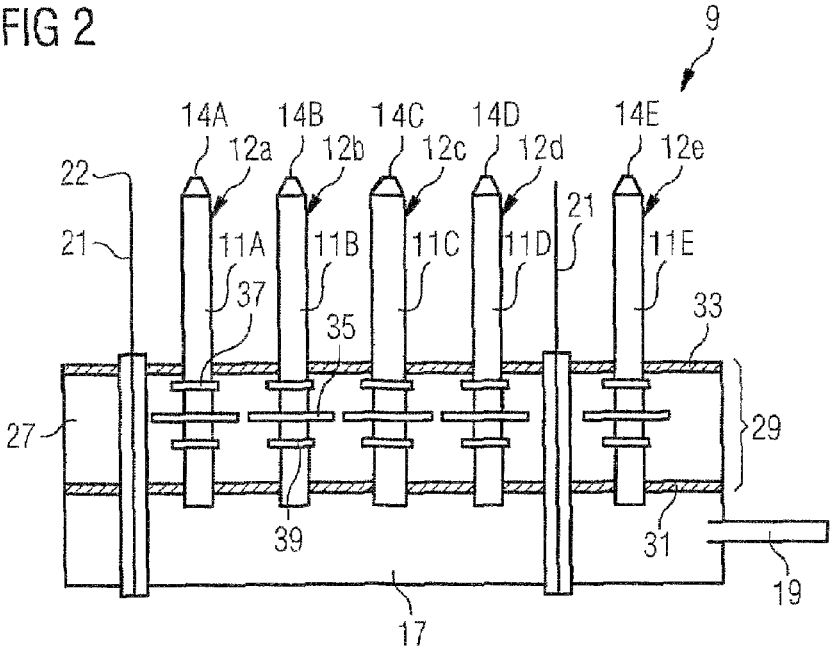
FIG. 2 shows a first exemplary embodiment of the opposing electrode arrangement according to the invention.

A first exemplary embodiment of the opposing electrode arrangement 9 according to the invention will now be described with reference to FIG. 2. The opposing electrode arrangement 9 has a plurality of tubular elements 11*a* to 11*e*, which form tubular process electrodes 12*a* to 12*e*. The process electrodes 12*a* to 12*e* can be connected to the pole of a voltage source via a line which is not illustrated in FIG. 2. All the process electrodes 12*a* to 12*e* are connected at one end to the distribution tank 17 such that a process medium, that is to say for example an electrolyte with dispersed microscale or nanoscale particles, can flow through the channels 13 in the interior of the process electrodes 12*a* to 12*e* (see FIG. 1) to the outlet openings 14*a* to 14*e*. The channels 13, the outlet openings 14, the distribution tank 17 and the inlet 19 have already been described with reference to FIG. 1, and will therefore not be explained again at this point.

In addition to the process electrodes 12*a* to 12*e*, the opposing electrode arrangement 9 also has a number of measurement electrodes 21, which are electrically isolated from the process electrodes 12*a* to 12*e*. The measurement electrodes 21 form reference electrodes whose electrode tips 22 point towards the surface 2 of the workpiece 1, without touching it, and are used to monitor the electrical parameters during the electrochemical deposition process. Like the process electrodes 11, the measurement electrodes 21 may be in the form of tubular elements. Alternatively, however, it is also possible for the measurement electrodes 21 to be in the form of solid electrodes, that is to say without an internal channel.

The process electrodes 12*a* to 12*e* extend in the axial direction through a mount 29 which is filled with wax 27. The mount 29 has a first mounting plate 31 facing the distribution tank 17, and a second mounting plate 33 facing away from the distribution tank 17. The two mounting plates 31, 33 have holes which allow axial movement of the process electrodes 12*a* to 12*e* with respect to mounting plates 31, 33 and are sealed to prevent liquid wax 27 emerging from the mount 29. The individual process electrodes 12 to 12*e* are equipped, in the area of those sections which are located in the interior of the mount 29, with flange-like attachments 35, 37 and 39 which secure the process electrodes 12*a* to 12*e* against axial movement relative to the mount 29 once the wax 27 has solidified.

The described process electrode arrangement 9 can advantageously be matched to the geometry of the workpiece surface 2. For this purpose, the wax 27 in the mount 29 is liquefied, for example by a heating means arranged in the mount 29 or by heating the electrolyte 3 in the container 5, so that the process electrodes 12*a* to 12*e* can move axially relative to the mount 29. In this state, the opposing electrode arrangement 9 is pressed with a slight pressure against the workpiece 1, so that the position of the openings 14*a* to 14*e* in the individual process electrodes 12*a* to 12*e* is matched to the geometric shape of the workpiece 1. The wax 27 is then cooled down so that it solidifies, and secures the process electrodes 12*a* to 12*e* against axial movement relative to the mount 29. The opposing electrode arrangement 9 is then once again moved somewhat away from the workpiece 1, with care being taken to ensure that the relative orientation of the opposing electrode arrangement 9 with respect to the workpiece 1 does not change.

Once the opposing electrode arrangement 9 has been matched to the geometric shape of the workpiece 1, the electrochemical deposition of the coating can be carried out. The maintenance of constant electrical parameters can be monitored by means of the measurement electrodes 21.

The electrode arrangement 9 according to the invention can be matched particularly well to the geometry of the workpiece 1 in the manner described without additionally having to produce a specifically shaped electrode for this purpose. Since the various openings 14*a* to 14*e* in the process electrodes 12*a* to 12*e* are at the same distance from the workpiece 1, the microscale or nanoscale particles which are directed in the direction of the surface can be distributed uniformly in the coating.

Figure 3:
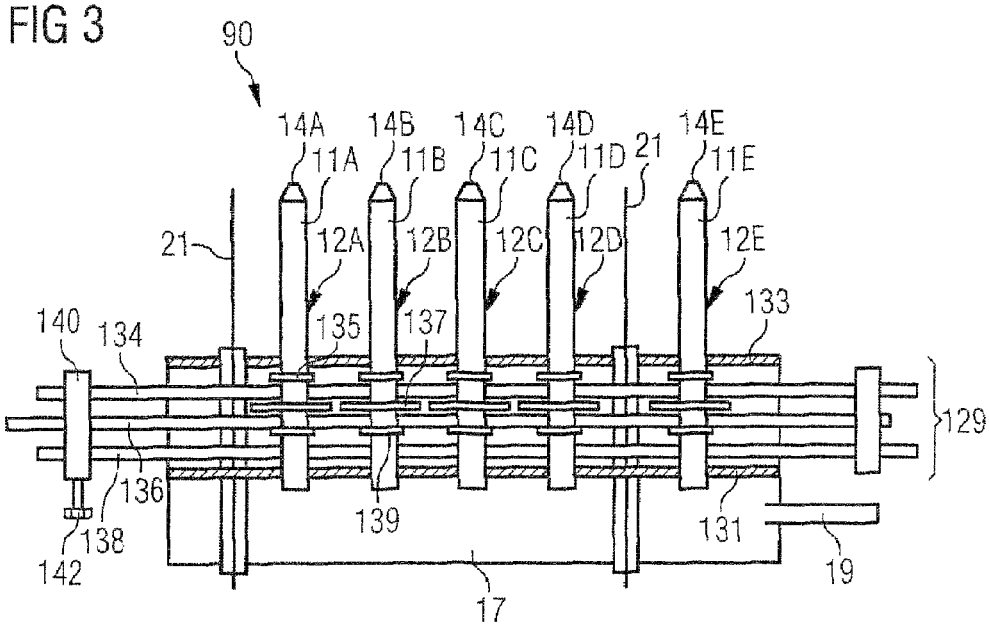
FIG. 3 shows a second exemplary embodiment of the opposing electrode arrangement according to the invention.

FIG. 3 illustrates a second exemplary embodiment of the process electrode arrangement 90 according to the invention. The process electrode arrangement 90 in the second exemplary embodiment differs from the process electrode arrangement 9 in the first exemplary embodiment only in the configuration of the mount 129. The other design features of the second exemplary embodiment, such as the process electrodes 12*a* to 12*e*, the distribution tank 17 or the measurement electrodes 21, are therefore annotated with the same reference numbers as the corresponding design features in the first exemplary embodiment, and will not be explained again at this point.

The mount 129 has a first mounting plate 131 facing the distribution tank 17, and a second mounting plate 133 facing away from the distribution tank 17. The two mounting plates have openings whose size is chosen such that a clearance remains between the edges of the openings and the process electrodes 11*a* to 11*e* that are passed through the mounting plates 131, 133, allowing axial movement of the process electrodes 12*a* to 12*e* relative to the mount 129. Adjustment plates 134, 136, 138 extend through the interior of the mount 129 and likewise have openings which are of such a size that the process electrodes 12*a* to 12*e* are passed through them with a clearance. The adjustment plates 134, 136, 138 therefore also, in a first state, do not impede axial movement of the process electrodes 12*a* to 12*e*. The possible axial movement of the process electrodes 12*a* to 12*e* is limited only by flange-like attachments 135, 137, 139 in that area of the process electrodes 12*a* to 12*e* which is located in the interior of the mount 129.

The adjustment plates 134, 136, 138 are held on two sides by a frame 140 with respect to which the central adjustment plate 136 can be moved. The adjustment plate 136 is moved parallel to the adjustment plates 134 and 138 and at right angles to the direction of the axial movement of the process electrodes 12*a* to 12*e*. Furthermore, the frame 140 has a fixing unit 142, for example in the form of one or more fixing screws, which allows the position of the central adjustment plate 136 to be fixed relative to the position of the two outer adjustment plates 134, 138.

The process electrode arrangement 90 in the second exemplary embodiment can be matched to the geometry of the workpiece 1 by moving the central adjustment plate 136 to a position in which the holes in the individual adjustment plates 134, 136, 138 as well as the holes in the two mounting plates 131, 133 are centered relative to one another such that their openings are arranged to be aligned with one another. In this first state, the opposing electrode arrangement 90 is pressed with a slight pressure against the workpiece 1 such that they rest, with those ends of the process electrodes 12*a* to 12*e* that are provided with the openings 14*a* to 14*e*, on the workpiece 1. The geometry of the workpiece 1 in this case ensures axial movement of the process electrodes 12*a* to 12*e*, which leads to the position of the openings 14*a* to 14*e*, being matched to the geometry of the workpiece. The central adjustment plate 136 is then moved parallel to the two outer adjustment plates 134, 138, so that the openings in the adjustment plates 134, 136, 138 are no longer aligned with one another. In this second state of the adjustment plates 134, 136, 138, the process electrodes 12*a* to 12*e* are pressed against one side of the hole edges of the outer adjustment plates 134, 138. At the same time, the process electrodes 12*a* to 12*e* are pressed against the hole edges of the central adjustment plate. Since the hole edges of the outer adjustment plates 134, 138 press against the process electrodes 12*a* to 12*e* in the opposite direction to the hole edges of the central adjustment plate 136, the process electrodes 12*a* to 12*e* are clamped between the hole edges of the outer adjustment plates 134, 138 on the one hand and the hole edges of the inner adjustment plate 136 on the other hand. In this state, the central adjustment plate 136 is fixed by means of the fixing device 142. The process electrodes 12*a* to 12*e* are secured in this way against axial movement. The electrochemical coating process is then carried out, as described with reference to the first exemplary embodiment, with the opposing electrode arrangement 9 matched in this way to the geometry of the workpiece 1.

In a modification of the second exemplary embodiment, it is also possible to design the two outer adjustment plates 134, 138 to be movable, and to design the central adjustment plate 136 such that it cannot be moved. A further alternative is to use network-like structures instead of the adjustment plates, which structures, for example, are produced from wires or cables and have grids through which those areas of the process electrodes which are located in the interior of the mount are passed. The opening cross section of the grids can be reduced by bracing the individual cables or wires with respect to one another, such that the wires or cables are pressed against the outside of the process electrodes, and therefore provide friction which impedes axial movement of the process electrodes.

The invention claimed is:

1. A method for electrochemical coating of a workpiece surface (2), with microscale or nanoscale particles being introduced into the coating, comprising the steps of:

immersing a workpiece into a container filled with an electrolyte; and during the coating process, directing a plurality of jets composed of a jet medium, which comprises the microscale or nanoscale particles to be introduced, at the workpiece surface (2).

2. The method as claimed in claim 1, characterized in that the jet medium is formed solely by the microscale or nanoscale particles.

3. The method as claimed in claim 1, characterized in that the microscale or nanoscale particles are dispersed in an electrolytic treatment solution, and the jet medium is formed by the electrochemical treatment solution with the microscale or nanoscale particles dispersed in it.

4. The method as claimed in claim 1, characterized in that the quantity of microscale or nanoscale particles introduced into the coating is varied by means of the jet pressure.

5. The method as claimed in claim 4, characterized in that the jet pressure is varied during the electrochemical coating process.

6. The method as claimed in claim 1, characterized in that the composition of the jet medium is varied during the electrochemical coating process.

7. The method as claimed in claim 2, characterized in that the quantity of microscale or nanoscale particles introduced into the coating is varied by means of the jet pressure.

8. The method as claimed in claim 3, characterized in that the quantity of microscale or nanoscale particles introduced into the coating is varied by means of the jet pressure.

9. A method for electrochemical coating of a workpiece surface (2), with microscale or nanoscale particles introduced into the coating, said method comprising the steps of:

immersing a workpiece and an opposing electrode arrangement into a container filled with an electrolyte, the workpiece having a workpiece surface;

electrically connecting a negative pole of a voltage source to the workpiece so that the workpiece forms a cathode;

electrically connecting a positive pole of a voltage source to the electrode arrangement so that the electrode arrangement forms an anode;

applying a voltage between the electrode arrangement and the workpiece to form an electrical field between the electrode arrangement and the workpiece; and while coating the workpiece, introducing a dispersion of microscale or nanoscale particles in the electrolyte, between the opposing electrode arrangement and the workpiece, by directing a plurality of pressurized jets, composed of a jet medium comprising the microscale or nanoscale particles and the electrolyte, at the workpiece surface.

* * * * *